US005123224A

United States Patent [19]

Olsen

[11] Patent Number: 5,123,224

[45] Date of Patent: Jun. 23, 1992

[54] DRAINABLE LOUVER

[75] Inventor: Robert W. Olsen, Washington, N.J.

[73] Assignee: Construction Specialties, Inc., Cranford, N.J.

[21] Appl. No.: 636,751

[22] Filed: Jan. 2, 1991

[51] Int. Cl.[5] ..... E06B 7/08

[52] U.S. Cl. ..... 52/473; 454/309

[58] Field of Search ..... 52/473, 209; 98/121.1, 98/121.2

[56] References Cited

U.S. PATENT DOCUMENTS 3,287,870 11/1966 Johnson .
3,782,050 1/1974 Dowdell et al. .
4,103,468 8/1978 Olsen .

FOREIGN PATENT DOCUMENTS 341556 1/1981 United Kingdom .

*Primary Examiner*—David A. Scherbel
*Assistant Examiner*—Creighton Smith
*Attorney, Agent, or Firm*—Brumbaugh, Graves, Donohue & Raymond

[57] ABSTRACT

A drainable louver comprises a frame composed of a sill, a head and a pair of side members forming a rectangular opening and a multiplicity of vertically spaced-apart louver blades extending across the opening between the side members and fastened to the side members. Each of the blades has a drainage trough extending along its lower front edge and terminating at each end adjacent a corresponding side member of the frame, and each of the side frame members has a base wall portion engaging the corresponding ends of the blades throughout their lateral extent. Each side member has a front flange portion defining with a front part of the base wall portion a vertical drainage channel located laterally of the corresponding ends of the drainage troughs of the louver blades on the side of the base wall portion opposite from the blade. The drainage channel of each side member has an opening at the front face of the frame throughout its vertical extent, and the front part of the base wall portion has an opening in register with the corresponding end of the drainage trough of each louver blade so that water can flow from the drainage trough of each blade into the drainage channel.

3 Claims, 2 Drawing Sheets

DRAINABLE LOUVER

BACKGROUND OF THE INVENTION

It is usually desirable and sometimes important to minimize the intrusion of water through a louver. In such instances so-called drainable louvers are often used. The principal characteristic of drainable louvers is the provision of a drainage trough at the lower front edge of each blade for catching water that impinges on the blade and preventing it from dripping off the front edge of the blade and becoming entrained in the air flow or falling onto the blade below and causing a splash of small droplets, some of which will become entrained in the air flow. The drainage troughs open at one or both ends into a drainage channel in a vertical side member—a jamb or a mullion—of the louver frame. Examples of drainable louvers are described and shown in U.S. Pat. Nos. 3,287,870 (Johnson, 1966), 3,782,050 (Dowdell et al., 1974) and 4,103,468 (Olsen, 1978) and British Patent No. 341,556 (White, 1931). In the louver of the Dowdell patent, each blade has a hole in the bottom of each drainage trough that lies behind a front flange of the jamb, and the corner areas of the jambs adjacent the vertically aligned holes in the troughs provides a form of drainage channel, in that water drained through the holes tends to cling to the jamb and run to the bottom of the louver. In the louvers of the Johnson and Olsen patents the drainage channels are U-shaped flange portions of the jambs that open laterally toward the ends of the drainage channels. The British patent proposes vertical downtakes formed by channel members set into notches in the lower front portions of the blades with holes opening laterally to the portions of the drainage troughs on either side and closed at the front by plates.

In many louver installations the environment makes the drainage troughs and channels prone to becoming clogged with leaves and other debris. Leaves and other wind-blown objects fall on the blades, wash into and along the troughs and get caught in the channel, plugging it. The blade immediately above a plug in a channel then becomes the recipient of all water drained from the blades above, which will probably back up into the drainage channel of the blade above the plug. That water overflows the lower front end of the blade and is highly subject to becoming entrained in the air flow entering the louver. Unlike raindrops falling at high velocity in front of the louver, water that falls off the front of the blades has a low velocity—hence the much greater tendency for it to become entrained in the flow and penetrate the louver. Also, water falling from the blade above a plugged drainage channel onto the next lower blade increases the splash and the quantities of small droplets, which are very prone to becoming entrained

SUMMARY OF THE INVENTION

One object of the present invention is to provide a drainable louver in which plugging of a vertical drainage channel is very unlikely to cause increased water penetration. Another object is to provide a drainable louver having vertical drainage channels serving the drainage troughs of the blades that are less likely to become plugged than are the drainage troughs of previously known drainable louvers. Yet another object is to provide a drainable louver in which the vertical drainage channels can readily be fitted with pitcher spouts or connected to downspouts not only at the time of original installation but at any later time.

A drainable louver according to the present invention includes, as does any conventional drainable louver, a frame composed of a sill, a head and a pair of side members forming a rectangular opening and a multiplicity of vertically spaced-apart louver blades extending across the opening between the side members and fastened to the side members, each of the blades having a drainage trough extending along its lower front edge and terminating at each end adjacent a corresponding side member of the frame. Each of the side frame members has a base wall portion engaging the corresponding ends of the blades throughout their lateral extent. The present invention is the improvement in an otherwise conventional drainable louver wherein each side member of the frame has a front flange portion defining a vertical drainage channel located laterally of the corresponding ends of the drainage troughs of the louver blades on the side of the base wall portion opposite from the blade, wherein the drainage channel of each side member is open at the front face of the frame throughout its vertical extent, and wherein the base wall portion of each side frame member has an opening in register with the corresponding end of the drainage trough of each louver blade so that water can flow from the drainage trough of each blade into the drainage channel.

In a preferred embodiment of the invention the drainage channel of each side frame member includes a front portion of the base wall portion, a rear wall portion extending from the base wall portion, and a side wall portion extending from the rear wall portion and spaced apart from the base wall portion. The rear wall portion and the side wall portion of the drainage channel define in cross section a generally L-shaped portion. Preferably, each side member includes a first front flange portion at the front extremity of the base wall portion and a second front flange portion at the front extremity of the side wall portion, said front flange portions being parallel to or coplanar with the front face of the frame.

By having the drainage channels open to the front face, they are less subject to becoming plugged with leaves or other debris, inasmuch as wind and wind-blown rain helps in dislodging debris. If the hole leading from a drainage trough of a blade to the drainage channel should become plugged, it is likely that most of the water collected in the trough will drain to the drainage channel at the other end of the blade. If any water spills over the edge of a blade having a plugged drain hole, the amount of water will that overflows will be minimal, because only water collected by that blade overflows, not an accumulation of water from the blades above it. In the unlikely event that a drainage channel does become plugged, water draining from above is likely to be released to the front face of the side frame member, rather than to a blade as is the case of a conventional side-opening drainage channel, and can flow freely down the front face and thence down the building wall. The likelihood of water released from a plugged drainage channel of a louver embodying the present invention becoming entrained in the air flow through the louver is minimal. The front-opening drainage channels also make it easier to install pitcher spouts and downspouts at the bottom of the side frame member or anywhere along it vertically; there is no need to cut holes in the frame member.

For a better understanding of the invention, reference may be made to the following description of an exemplary embodiment, taken in conjunction with the accompanying drawings.

DESCRIPTION OF THE EMBODIMENT

Figure 1:
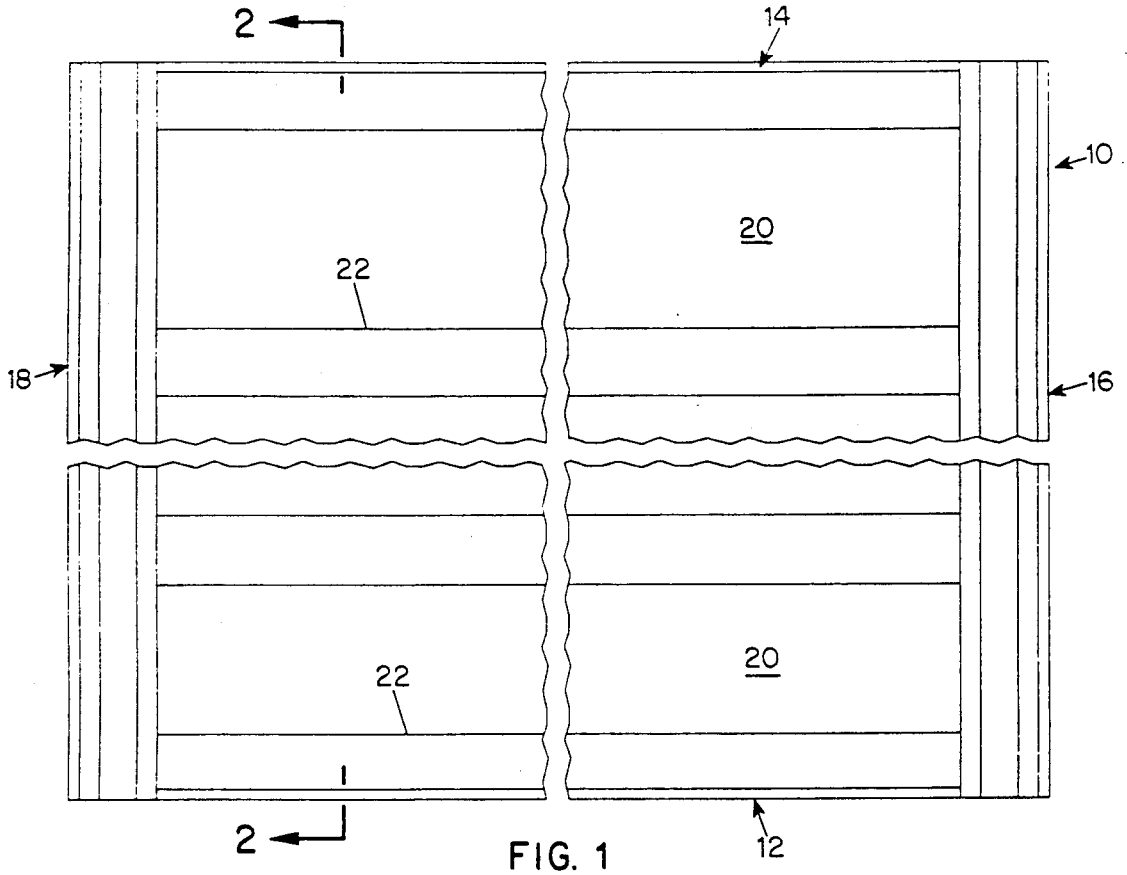
FIG. 1 is a front elevational view of the embodiment, center portions both vertically and horizontally being broken away.

The embodiment of a drainable louver shown in the drawings has a frame 10 composed of a sill 12, a head 14 and a pair of side members or jambs 16 and 18 forming a rectangular opening and a multiplicity of vertically spacedapart louver blades 20 extending across the opening between the jambs and fastened to them. Each of the blades has a drainage trough 22 extending along its lower front edge and terminating at each end adjacent a corresponding jamb. The jambs 16 and 18 are lengths cut from aluminum extrusions and are identical to each other, except that one is inverted end to end with respect to the other in the assembled frame and the holes for fastening the blades and the openings (described below) to the drainage troughs are mirror images in the respective jambs. Each jamb 16, 18 includes a planar base wall portion 24 (see FIG. 3) that is engaged by a corresponding end of each of the blades throughout its lateral extent. The blades are also lengths cut from aluminum extrusions and are thus of uniform cross section along their lengths. Screw-receiving bosses 26 formed in the blades receive screws (not shown) that pass through holes in the base wall portion and fasten the blades to the jambs. The blades 20 shown in the drawings are of a unique design that provides a maximum free area and are described in detail in U.S. Pat. No. 5,048,253 (Olsen, Sep. 17, 1991 which is filed concurrently herewith and is hereby incorporated by reference into the present specification.

Figure 2:
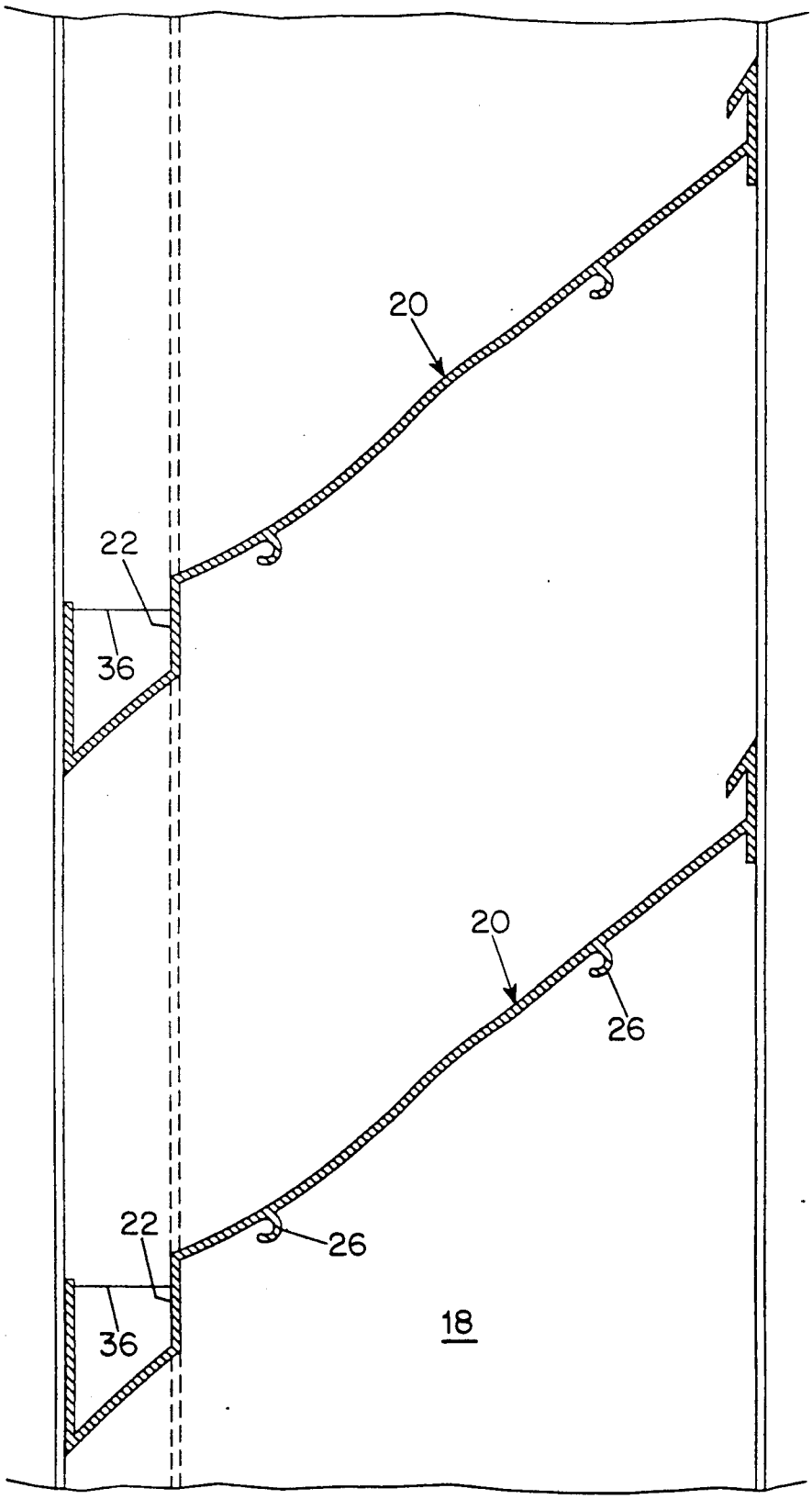
FIG. 2 is a fragmentary end cross-sectional view of the embodiment taken along the lines 2—2 of FIG. 1.

In cross section (see FIG. 3) each jamb 16, 18 of the louver frame is of overall U-shape and includes the planar base wall portion 24 referred to above, a rear flange portion 28 and a generally L-shaped front flange portion 30 that defines in part a vertical drainage channel 32 located laterally of the corresponding ends of the drainage troughs 22 of the louver blades on the side of the base wall portion 24 of the respective jamb opposite from the blades. The drainage channel 32 of each jamb has an opening 34 that is presented at the front face of the jamb and extends throughout the vertical extent of the jamb. The drainage channel is further defined by a front part **24*a* of the base wall portion. The front part 24*a* has holes 36 (see FIG. 2**) that register with the corresponding ends of the drainage troughs of the louver blades. Water captured in the drainage troughs of the blades flows along the troughs to the ends of the blades, passes through the holes into the drainage channels of the jambs, flows down the channels to the bottom of the louver, and is released from the channels and flows down the building wall.

The L-shaped front flange portion 30 that defines the drainage channel of the jamb 16, 18 includes a rear wall portion **30*a* extending orthogonally from the base wall portion 24 in a direction opposite from the louver blades and a side wall portion 30*b* extending from the rear wall portion and spaced apart from the base wall portion. A first front web portion 24*b* at the front extremity of the base wall portion and a second front web portion 30*c* at the front extremity of the side wall portion 30*b* are parallel with the front face of the louver frame and have their edges that are nearer each other spaced apart to define the continuous vertical front opening 34 of the drainage channel 32. The web portions 24*b* and 30*c* extend a small distance inwardly from the sides walls of the channel 32** to aid in confining water to the channel and also serve to capture plugs, pitcher spouts and downspouts (not shown), which may be installed to control the discharge of water from the drainage troughs to minimize or prevent staining of the building wall. These drainage control accessories can be designed to fit snugly into the drainage channels and can be fastened in place with an adhesive or mechanical fasteners at any desired locations vertically.

Figure 4:
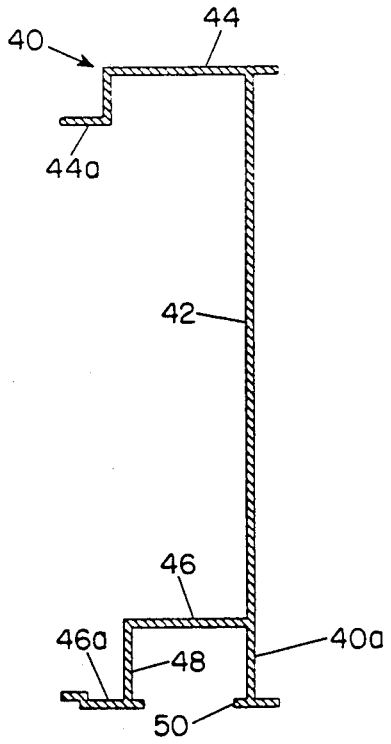
FIG. 4 is a top cross-sectional view of a mullion.

Louvers are often installed in side-by-side groups of two or more in a single opening in the building wall. In such installations the vertical junctures between adjacent louvers are formed by mullions. In the embodiment of the present invention shown in the drawings the mullions are composed of a jamb 16 or 18 of one of the side by side louvers and a mullion of the other louver. A mullion 40, which is shown in FIG. 4, is substituted as a vertical member of the frame on one or both sides of a louver that is adjacent a jamb of another louver in a side-by-side group. The mullion 40 mates with the jamb 16, 18 by interlocking slip joints, as described below. The mullion 40 is similar to the jamb 16, 18 in that it includes a planar base wall portion 42, a rear flange portion 44, and a generally L-shaped front flange portion 46 that defines with a front part **40*a* of the base wall portion a vertically continuous drainage channel 48 having an opening 50 at the front face of the frame. The front part 40*a*** of the base wall portion has holes (not shown) that register with the drainage troughs of the louver blades and holes (also not shown) for the screws that fasten the blades to it.

Figure 3:
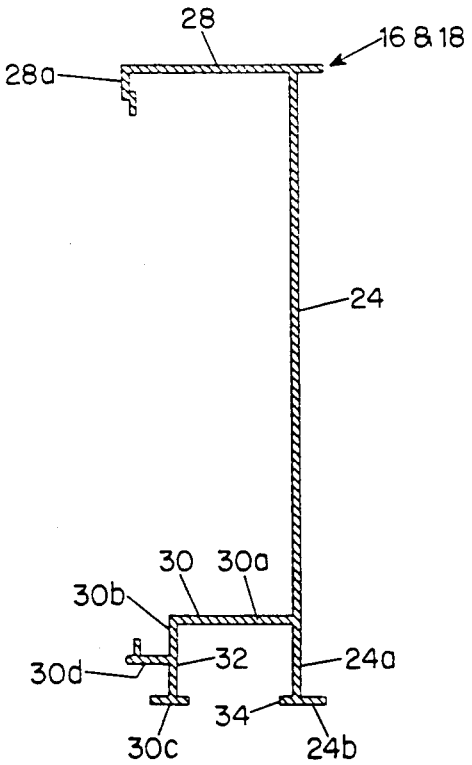
FIG. 3 is a top cross-sectional view of a jamb/mullion embodying the present invention.

The mullion differs from the jamb only in that it includes different interfitting flanges. The jamb 16, 18 has an interned rear interfitting flange part **28*a* on the rear flange portion 28 and a projecting interfitting flange part 30*d* on the front flange portion that are designed to mate with either frame members of the building or with the mullion 40. The mullion 40 has an L-shaped flange part 44*a* extending from the rear flange portion 44 and a projecting leg part 46*a* on the front flange portion 46. When a louver with a jamb is assembled side by side with a louver with a mullion, the flange part 28*a* of the jamb is received flatwise against the leg 44*b* of the flange part 44*a* of the mullion, and the flange part 46*a* of the mullion 40 forms an interfitting slip joint with the web portion 30*c* of the front flange portion of the jamb, the offset in the flange part 46*a* accepting the projecting leg of the web part such that the front faces of the flange part 46*a* and the web part 30*c* are coplanar. (When louvers are installed in side-by-side groups in the building opening, the mullion of one louver, as it is shown in FIG. 4, is inverted end for end with respect to the jamb of the other louver, as it is shown in FIG. 3**.)

I claim:

1. In a drainable louver having a frame composed of a sill, a head and a pair of side members forming a rectangular opening and a multiplicity of vertically spaced-apart elongated louver blades extending across the opening between the side members, each end of each blade lying in a plane orthogonal to the longitudinal axis of the blade throughout its lateral extent, and being fastened at its ends to the side members, each of the blades having a drainage trough extending along its lower front edge and terminating at each end adjacent a corresponding side member of the frame and each of the side frame members having a substantially planar base wall portion engaging the corresponding ends of the blades throughout the lateral extents of the blades, the improvement wherein each side member has a front flange portion of generally L-shape in cross section and disposed laterally of the base wall portion on the side thereof opposite from the louver blades and defining with a front part of the base wall portion a vertical drainage channel located laterally of the corresponding ends of the drainage troughs of the louver blades on the side of the base wall portion opposite from the blade, wherein the drainage channel of each side member has an opening at the front face of the frame throughout its vertical extent, and wherein the front part of the base wall portion has an opening in register with the corresponding end of the drainage trough of each louver blade so that water can flow from the drainage trough of each blade into the drainage channel.

2. The improvement according to claim 1 wherein the flange portion of each side frame member includes a rear wall portion extending from the base wall portion in a direction opposite from the louver blades and a side wall portion extending from the rear wall portion and spaced apart from the base wall portion.

3. The improvement according to claim 2 wherein each side member includes a first front web portion at the front extremity of the base wall portion and a second front web portion at the front extremity of the side wall portion, said front web portions being parallel to the front face of the frame and having their edges that are nearer each other spaced apart to define the continuous vertical front opening of the drainage channel.

* * * * *